United States Patent [19]

Hanson

[11] 4,407,081

[45] Oct. 4, 1983

[54] BUCKET TOOTH ATTACHMENT MEANS

[75] Inventor: Charles B. Hanson, Burlington, Iowa

[73] Assignee: J. I. Case Company, Racine, Wis.

[21] Appl. No.: 328,129

[22] Filed: Dec. 7, 1981

[51] Int. Cl.[3] ..... E02F 9/28

[52] U.S. Cl. ..... 37/141 T; 172/704; 172/777; 37/DIG. 19

[58] Field of Search ..... 37/118 R, 141 R, 141 T, 37/142 R, 142 A, DIG. 19; 172/777, 701.1, 703, 704, 713; 299/91

[56] References Cited

U.S. PATENT DOCUMENTS

| | | | |
|---|---|---|---|
| 1,461,136 | 7/1923 | Moore | 37/142 R |
| 1,548,375 | 8/1925 | Mullally | 37/118 R |
| 2,584,416 | 2/1952 | Boehringer | 37/142 R X |
| 2,870,552 | 1/1959 | Richardson | 37/142 R |
| 3,995,384 | 12/1976 | Wood | 37/141 T X |
| 4,182,058 | 1/1980 | Poncin | 37/142 A |
| 4,290,214 | 9/1981 | Stepe | 37/141 T |

*Primary Examiner*—Edgar S. Burr
*Assistant Examiner*—Moshe I. Cohen
*Attorney, Agent, or Firm*—Dressler, Goldsmith, Shore, Sutker & Milnamow, Ltd.

[57] ABSTRACT

A bucket for use in conjunction with earth working and material handling implements having a plurality of tooth members associated therewith. The bucket includes a cutting-edge plate secured to the leading edge of a backwall plate. The cutting-edge plate has a plurality of downwardly extending transversely spaced tongue portions associated with a forward end thereof. The tooth members have transverse grooves formed in the upper surfaces thereof for receipt of the tongue portions. Each tooth member has a pair of oppositely disposed beveled portions to permit reversal thereof on the cutting-edge plate.

3 Claims, 5 Drawing Figures

BUCKET TOOTH ATTACHMENT MEANS

BACKGROUND OF THE INVENTION

This invention is related to earthworking and material handling implements and more particularly to buckets and scoops of the type having a plurality of tooth members used to facilitate the bucket or scoop in engaging an embankment or a pile of material.

For the most part those buckets and scoops used in material handling applications consist of a pair of sidewalls, a bottom wall which interconnects the sidewalls and provides a forwardly disposed lip or digging edge, and a plurality of tooth members fixedly or removably mounted along the forward edge of the backwall lip. The bucket itself is connected to a pivotal arm such as a dipperstick of a backhoe or lift arms of a loader. When the bucket is placed in operation the dipperstick or arm is moved into an embankment or pile of material so as to force the tooth members to penetrate the material. The tooth members as such form a wedge to facilitate the bucket engaging and breaking out of the material. As can be appreciated the tooth members are exposed to substantial bending stresses and, relative to the main body of the bucket, are rapidly worn away through use.

Heretofore, it has been common practice to provide tooth members which are especially hardened or configured to resist wear and to mount the tooth members to a shank, which in turn is welded to the lip of the bucket in a manner that the stresses imposed on the teeth are distributed to the maximum extent to the backwall and the sidewalls of the bucket. Those skilled in the art know that these practices have not been entirely satisfactory. These buckets present a certain amount of obstruction to digging and are often difficult to service in the field. Further, the cost of manufacturing these tooth members and the cost of maintaining the bucket in a good working condition have been relatively high. What is needed is a relatively simple bucket design having a set of tooth members incorporated therein which is inexpensive to manufacture, easy to install, easy to maintain, particularly in the field or at the job site, and does not obstruct the digging action. A bucket design incorporating such features is likely to be enthusiastically accepted by the industry.

SUMMARY OF THE INVENTION

In accordance with the present invention a bucket is provided that is formed from two transversely spaced sidewalls or sidewall plates, a backwall plate which joins together the sidewall plates to form a scoop-shaped opening, a cutting edge plate which is disposed between the sidewalls and along the leading edge of the backwall plate, and a plurality of spaced, generally flat, tooth members which have two oppositely disposed beveled portions and which are carried by the cutting-edge plate. The cutting-edge plate has a plurality of downwardly extending, transversely spaced, tongue portions positioned immediately inward of the leading edges of the sidewall plates. The tooth members have transverse grooves formed in the upper surfaces thereof intermediate the beveled portions for respective receipt of the tongue portions of the cutting-edge plate. The tongue portions and grooves are preferably of trapezoidal-shape cross-section so as to permit the tooth members to transversely slide into and out of engagement with the tongue portions of the cutting-edge plate. The tooth members are symmetrical about an imaginary transverse plane passing therethrough such that the tooth members can be reversed so as to expose their opposite beveled portion.

More specifically, the cutting-edge plate includes a forward portion which extends outward of the leading edge of the backwall plate and a rearward portion which extends below the backwall plate. The tongue portions extend downward from the forward portion of the cutting-edge plate. The upper surface of the rearward portion of the cutting-edge plate is preferably inset for receipt of the backwall plate so as to create a non-obstructed digging surface. The upper surfaces of the beveled portions of the tooth members preferably have undercut sections on both sides of the groove. These undercut sections cooperate with corresponding downwardly extending protrusions associated with the lower surface of the rearward portion of the cutting-edge plate to facilitate installation and removal of the tooth members. A wear indicator is preferably provided on both beveled portions to indicate when the tooth is sufficiently worn that reversal or replacement is necessary. Further, openings are provided through the tongue portions and the grooves for receipt of a fastener therethrough. These respective openings preferably have center lines which are slightly offset such that the fastener transmits a binding action so as to firmly retain the tooth members in place.

Numerous other features and advantages of the present invention will become readily apparent from the following detailed description of the invention, from the claims and from the accompanying drawings.

DESCRIPTION OF THE PREFERRED EMBODIMENT

Figure 1:
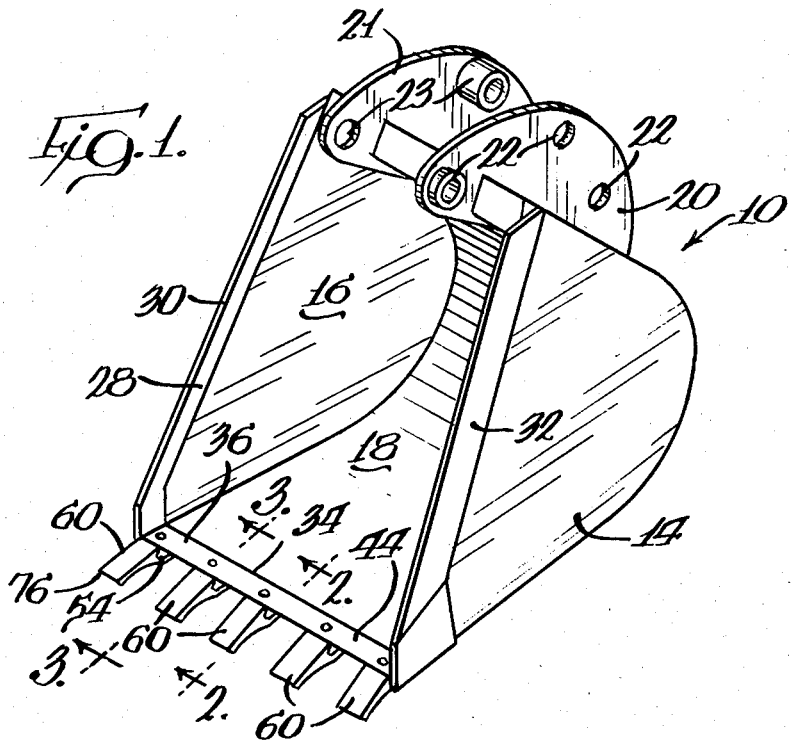
FIG. 1 is a perspective view of the bucket that is the subject of the present invention.

While this invention is susceptible of embodiment in many different forms, there is shown in the drawings and will herein be described in detail a specific embodiment with the understanding that the present invention is to be considered as an exemplification of the principles of the invention and is not intended to limit the invention to the specific embodiment illustrated.

Figure 2:
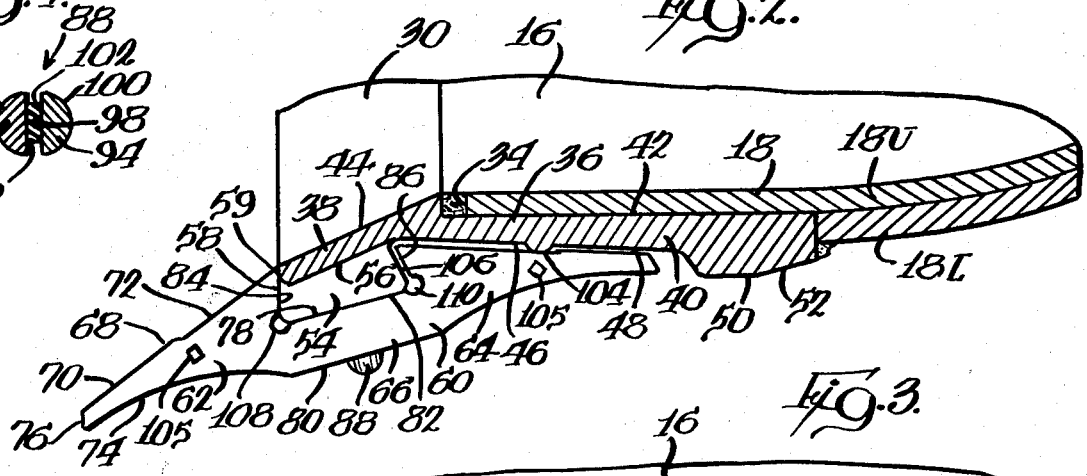
FIG. 2 is an enlarged cross-sectional view taken along line 2—2 of the forward portion of the bucket illustrated in FIG. 1.
Figure 3:
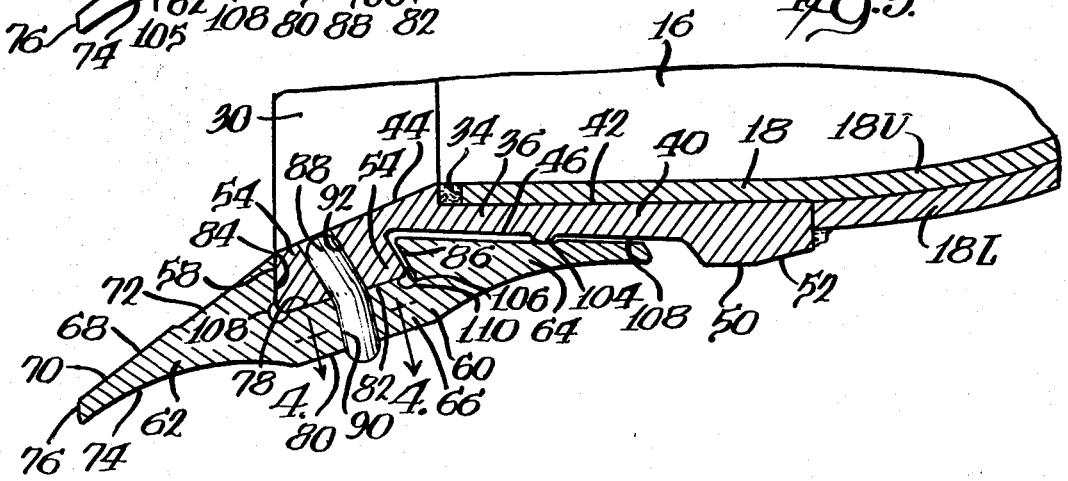
FIG. 3 is an enlarged, cross-sectional view taken along line 3—3 of the forward portion of the bucket illustrated in FIG. 1.
Figure 5:
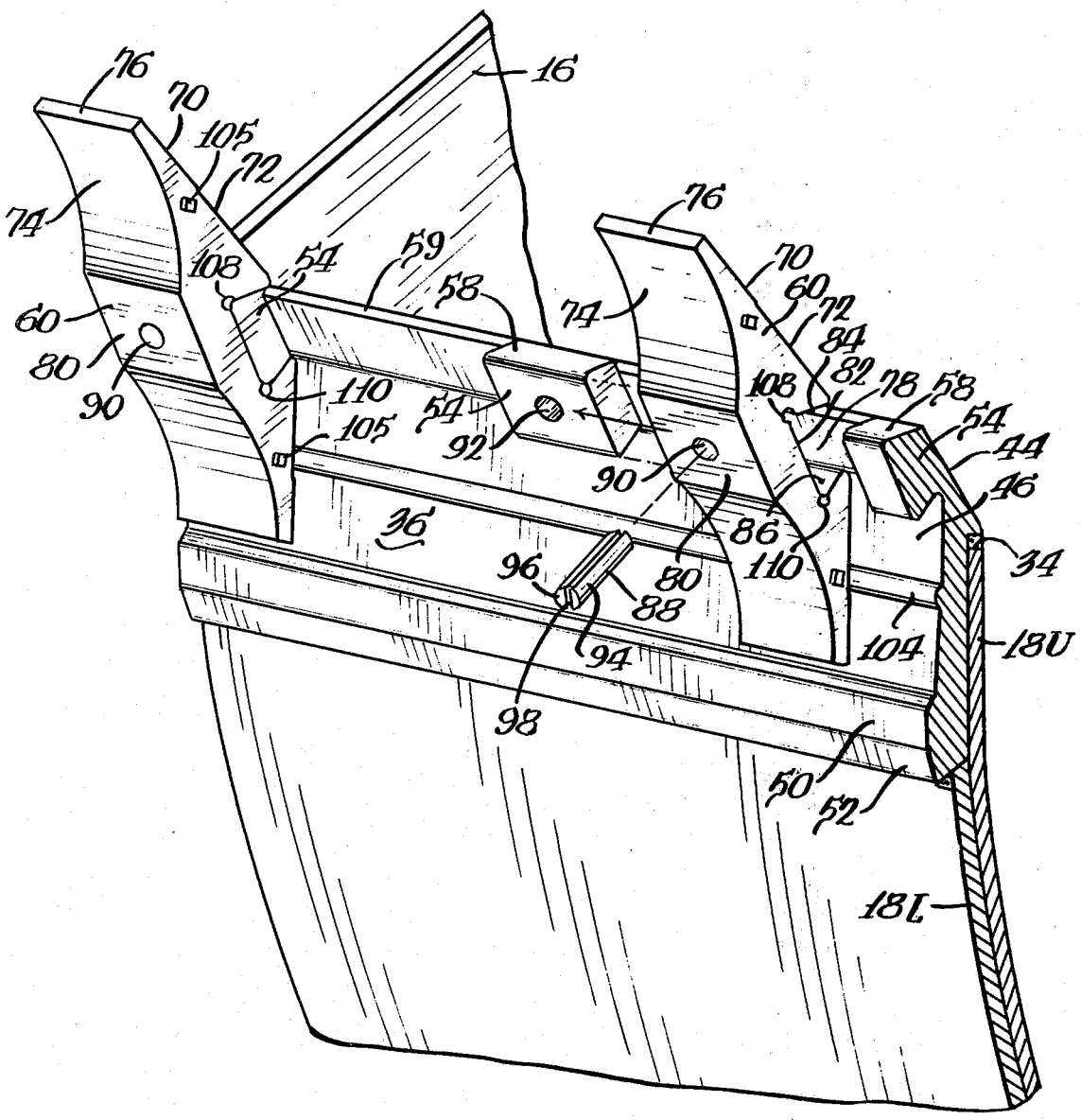
FIG. 5 is an enlarged, perspective view of a bottom section of the forward portion of the bucket illustrated in FIG. 1, having some of the components thereof disposed in exploded relation.

Referring to FIG. 1, a perspective view of a bucket 10 is shown incorporating the principles of the invention. The main body of the bucket is formed from two vertically disposed, spaced-apart sidewall plates 14 and 16 which are connected together by a backwall plate 18 so as to form a generally scoop-shaped enclosure. The backwall plate 18 and the two sidewall plates 14 and 16 are preferably securely joined together by a process such as welding. The backwall of the bucket can be formed from two separate plates sandwiched together (a so-called double wrapper design). FIGS. 2, 3 and 5 illustrate the backwall 18 formed from two backwall plates 18U and 18L. One of these plates 18U defines the inside of the bucket 10 while the other plate 18L defines the outside surface of the bucket 10. Alternatively, plate 18L can be replaced by a plurality of transversely spaced wear strips (not shown).

The bucket 10 is adapted to be connected to an implement, such as the dipperstick of a backhoe or the lift arms of a loader, by suitable mounting brackets. In FIG. 1 two lugs 20 and 21 are attached to the outside surface of the backwall plate 18. Each of the lugs is provided with a series of transversely aligned apertures 22 and 23 so as to form a clevis-like mounting arrangement. A connecting link (not shown) is disposed between the two lugs and pivotally connected to the lugs through a selected pair of aligned apertures.

Reinforcing plates are used to strengthen the main body of the bucket 10. As seen in FIG. 1, the exposed upper edges 28 (only one being shown) of each of the sidewall plates 14 and 16 are protected by generally elongated straight-edged reinforcing plates 30 and 32. Similarly, the leading edge 34 of the backwall plate 18 is reinforced with a cutting-edge plate 36, which is immediately hereinbelow described in greater detail.

Referring to FIGS. 2, 3 and 5, cutting-edge plate 36 is preferably formed from cast steel to a specific profile in accordance with the present invention. The cutting-edge plate 36 has a generally flattened V-shaped cross-section having a forward portion 38 and a rearward portion 40. The upper surface 42 of portion 40 is recessed or undercut with respect to the upper surface 44 of portion 38. The lower surface 46 of portion 40 is formed with a forward recessed or undercut surface 48 and a rearward surface 50. The rear section of surface 50 is preferably beveled upwardly at 52 to guide the bucket 10 in an upward direction.

The forward portion 38 of cutting-edge plate 36 has a plurality of transversely spaced tongue portions 54 formed integrally therewith and depending downwardly from a lower surface 56 thereof. Tongue portions 54 are preferably trapezoidal-shaped in cross-section and have leading surfaces 58 which are in alignment with the leading or digging edge 59 of the forward portion 38. A tongue portion 54 is preferably positioned adjacent to each of the transverse ends of forward portion 38 and one or more tongue portions 54 are transversely spaced therebetween.

Cutting-edge plate 36 is positioned with respect to backwall 18 such that a forward portion of the backwall plate 18U is received on surface 42. In such position, the rear edge of cutting-edge plate 36 preferably abuts up against the leading edge of backwall plate 18L. The leading edge 34 of backwall plate 18U preferably terminates a short distance from the upper surface 44 of forward portion 38. Cutting-edge plate 36 is rigidly secured to backwall plate 18U by welding along leading edge 34 and to backwall plate 18L by welding along the rear edge thereof. In order to create a non-obstructed surface for digging and cleaning, the depth of the recess of surface 44 is approximately equal to the thickness of backwall plate 18U.

A plurality of tooth members 60 are disposed at the leading edge 59 of the cutting-edge plate 36. A tooth member 60 is releasably secured to each tongue portion 54. Tooth member 60 is preferably formed from cast or forged steel, or the like, to a specific profile in accordance with the present invention. Tooth member 60 has a pair of oppositely disposed generally beveled portions 62 and 64 separated by a central portion 66. An imaginary transverse plane passing through the center of portion 66 divides tooth member 60 in half, one half being the mirror image of the other half. As will become hereinbelow more apparent, this permits the tooth member to be reversed. Accordingly, since beveled portions 62 and 64 are of identical configuration, it is necessary to only describe the configuration of portion 62; it being understood that portion 64 is the mirror image thereof.

Beveled portion 62 has an upper surface 68, having a forward section 70 and a rearward section 72, which is inset with respect to forward section 70. The lower surface 74 of beveled portion 62 is preferably arcuate so as to define a generally pointed digging edge 76. Central portion 66 has a generally trapezoidal-shaped transverse groove 78 cut into the upper surface thereof. Rearward sections 72 of the upper surfaces 68 of portions 62 and 64 terminate at the respective upper edges of groove 78. Groove 78 is of the same general shape and dimensions as tongue portions 54. The lower surface 80 of central portion 66 is generally parallel to the bottom surface 82 of groove 78. Groove 78 is further defined by a forward end surface 84 and rearward end surface 86. In order to permit reversability of the tooth member, the angle between surface 84 and surface 82 and the angle between surface 86 and surface 82 are the same.

Figure 4:
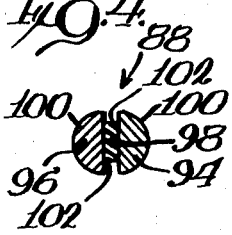
FIG. 4 is an enlarged, cross-sectional view taken along line 4—4 of the fastener illustrated in FIG. 3.

Referring specifically to FIG. 5, it can be seen that tooth members 60 are transversely slideable over tongue portions 54, such that the tongue portions are received in corresponding grooves of the tooth members 60. In the embodiment as illustrated, the tooth members may be installed and removed from either direction. Also, at such time as beveled portions 62 become worn down, the tooth members 60 can be reversed to present beveled portions 64 as the digging edge. The tooth members 60 are preferably removably secured to the cutting-edge plate 36 by fasteners 88 extending through openings 90 and 92, which extend respectively through central portion 66 of tooth member 60 and tongue portion 54 of cutting-edge plate 36. Referring to FIGS. 4 and 5, fastener 88 is preferably a pin member fabricated of two metal sections 94 and 96 sandwiched about a center or spreader section 98. The metal sections are preferably alike and extend longitudinally of the pin and each has an outer convex face 100 and an inner flat face 102. The center section 98 is made from a strip of rubber, or the like, which is confined between the flat inner faces 102. Such a fastener is well known in the art.

Referring to FIG. 3, in accordance with a preferred form of the invention, the center lines which pass through openings 90 and 92 preferably intersect at a small angle to one another. With such a relationship, upon forcing the fastener 88 through the respective openings 90 and 92, the fastener is caused to deflect and the leading surface 58 of tongue portion 54 is forced against the side surface 84 of groove 78 so as to create a binding action and thereby hold the tooth member 60 on cutting-edge plate 36.

In order to facilitate the installation and removal of the tooth members 60, a protrusion or rest point 104 is preferably formed on a central portion of surface 48. Rest point 104 is positioned to contact rearward section 72 of beveled portion 64, adjacent to the outer end of section 72, so as to space surface 68 from surface 48. By such an arrangement the likelihood of the tooth member 60 being hung up on imperfections in surface 48 or surface 68 is materially reduced. Further, since section 72 is recessed from section 70, which is the surface of the tooth member 60 which is subjected to wear during operation of the bucket, the space relationship of section 72 is not likely to be affected by normal operation of the bucket. Since it is important that the section 72 not be worn in the area which contacts the rest point 104, so as to permit the tooth member 60 to be reversed, a suitable wear indicator 105 is preferably provided on a side surface of tooth member 60 to indicate to an operator when the beveled portion 62 is worn away and the tooth member should be reversed.

To further facilitate the installation and removal of the tooth members 60, the groove 78 is preferably dimensioned slightly larger than the tongue portion 54. As alluded to hereinabove, the fastener 88 is effective to firmly retain surface 58 of tongue portion 54 against surface 84, which creates a minimum clearance, indicated at 106, between tongue portion 54 and surface 86.

In the preferred form of the invention, the corners of groove 78 have material removed therefrom at 108 and 110 to reduce stress concentrations on the tooth member 60.

Thus, from the foregoing description and the appended drawings, it should be evident that the present invention provides an improved bucket, and particularly an improved tooth design and support arrangement for such bucket. Although the invention has been described in conjunction with a specific embodiment, it should be understood that various modifications in the structure may be made without departing from the spirit and essential characteristics of the invention. For example, it is anticipated that the tongue portions can be formed such that the tooth members are only installed and removed from one side. Also, the rest point can be formed in interupted sections which are in longitudinal alignment with the tongue portions. Additionally, the forward portion of the cutting edge plate can be formed with increased cross-sectional areas at its upper surface, adjacent to the tongue portions, so as to increase the strength of the cutting edge plate at the sections of support of the tooth members. All such modifications and variations are to be included within the scope of the appended claims.

What is claimed is:

1. A bucket for use in conjunction with earth-working and material handling implements, comprising:

(a) a pair of transversely spaced sidewall plates;

(b) a backwall plate joining together said sidewall plates to define a scoop-shaped opening, one edge of said backwall plate being recessed relative to the leading edges of said sidewall plates;

(c) cutting-edge plate means carried between the leading edges of said sidewall plates ahead of said one edge of said backwall plate, said cutting-edge plate means having a plurality of downwardly extending transversely spaced tongue portions positioned immediately inward of the leading edges of said sidewall plates and a forward portion which extends outward from said one edge of said backwall plate and a rearward portion which extends immediately below said backwall plate, (d) generally flat reversible bucket tooth means having two oppositely disposed beveled portions removably mounted to said tongue portions, said tooth means having a transverse groove formed in the upper surface thereof intermediate to said beveled portions for receipt of said tongue portions therein as said tooth means is transversely moved into engagement therewith, the upper surfaces of said beveled portions having undercut sections on both sides of said groove and the lower surface of said rearward portion of said cutting-edge plate includes a downwardly projecting protrusion for contact with said undercut sections.

2. The invention as defined in claim 1 wherein a wear indicator is provided on the side surface of said tooth means adjacent to the outer edge of said undercut sections.

3. The invention as defined in claim 1 wherein said upper surface of said undercut sections are a smooth continuation of the upper surface of said forward portion of said cutting-edge plate means.

* * * * *